US010442209B2

(12) United States Patent
Horade

(10) Patent No.: US 10,442,209 B2
(45) Date of Patent: Oct. 15, 2019

(54) LIQUID DISCHARGING APPARATUS

(71) Applicant: BROTHER KOGYO KABUSHIKI KAISHA, Nagoya-shi, Aichi-ken (JP)

(72) Inventor: Kenta Horade, Tokai (JP)

(73) Assignee: BROTHER KOGYO KABUSHIKI KAISHA, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/902,434

(22) Filed: Feb. 22, 2018

(65) Prior Publication Data

US 2018/0244065 A1 Aug. 30, 2018

(30) Foreign Application Priority Data

Feb. 28, 2017 (JP) ..... 2017-036801

(51) Int. Cl.
*B41J 2/175* (2006.01)
*B41J 2/165* (2006.01)
*B41J 2/045* (2006.01)

(52) U.S. Cl.
CPC ..... *B41J 2/17566* (2013.01); *B41J 2/04571* (2013.01); *B41J 2/16505* (2013.01); *B41J 2002/17589* (2013.01)

(58) Field of Classification Search
CPC ..... B41J 2/17566; B41J 2/04571; B41J 2/16505; B41J 2002/17589
See application file for complete search history.

(56) References Cited

U.S. PATENT DOCUMENTS

2010/0020142 A1* 1/2010 Bannai ..... B41J 2/17506 347/86

FOREIGN PATENT DOCUMENTS

JP 2016-153199 A 8/2016
JP 2016-190402 A 11/2016

OTHER PUBLICATIONS

IBM Technical Disclosure Bulletin, "Ink Balance Control for an Ink Jet Printer", Sep. 1989, IBM, Disclosure Text (Year: 1989).*
IP.com search (Year: 2019).*

* cited by examiner

*Primary Examiner* — Lisa Solomon
(74) *Attorney, Agent, or Firm* — Scully, Scott, Murphy & Presser, P.C.

(57) ABSTRACT

There is provided a liquid discharging apparatus including a liquid discharge head, a tank, and a controller configured to perform: estimating an amount of liquid remained in the tank; estimating a viscosity of the remained liquid; estimating an amount of the refilled liquid; estimating a viscosity of the refilled liquid; and estimating a viscosity of a mixed liquid of the remained liquid and the refilled liquid at a point of time of finishing a refill of the tank with the liquid, based on the estimated amount of the remained liquid, the estimated viscosity of the remained liquid, the estimated amount of the refilled liquid, and the estimated viscosity of the refilled liquid.

17 Claims, 12 Drawing Sheets

LEFT ⟷ RIGHT
SCANNING DIRECTION

→
CONVEYANCE DIRECTION

LIQUID DISCHARGING APPARATUS

CROSS REFERENCE TO RELATED APPLICATION

The present application claims priority from Japanese Patent Application No. 2017-036801, filed on Feb. 28, 2017, the disclosure of which is incorporated herein by reference in its entirety.

BACKGROUND

Field of the Invention

The present teaching relates to liquid discharging apparatuses discharging liquid.

Description of the Related Art

As an example of liquid discharging apparatus discharging liquid, conventionally, there are disclosed ink jet printers configured to jet an ink to carry out printing. For example, there are known ink jet printers including an ink tank connected to an ink jet head. The ink tank is provided with an ink refill port for refilling with the ink, and is capable of refilling with the ink from the ink refill port.

SUMMARY

In an ink jet printer described above, if the ink tank is refilled with the ink, then some residual ink (old ink) remained in the ink tank will be mixed with the refill ink (new ink) with which the ink tank is refilled. Because the residual ink and the refill ink differ from each other in viscosity due to the difference in preservation state and the like at the point of refilling with the refill ink, the mixed ink of the residual ink and the refill ink differs in viscosity from both the residual ink and the refill ink. Further, because a user can refill the ink tank with the refill ink at an arbitrary time, there is an uncertain mixture ratio between the residual amount of the residual ink remaining in the ink tank, and the refill amount of the refill ink at the point of refilling with the refill ink; therefore, because the mixture ratio changes at each time of refilling with the refill ink, there is also an uncertain change in the viscosity of the mixed ink. Accordingly, it is difficult to calculate the viscosity of the mixed ink. Therefore, the ink jet printer described above has not calculated the viscosity of the mixed ink. However, the property of ink jet, the amount of ink discharge from nozzles in purge or flushing, etc., change with the viscosity of the ink inside the ink tank; therefore, it is desirable to be able to correctly grasp, to a certain degree, the viscosity of the ink inside the ink tank, based on the residual amount of the residual ink and the refill amount of the refill ink.

An object of the present teaching is to provide a liquid discharging apparatus capable of correctly estimating the viscosity of a mixed ink.

According to an aspect of the present teaching, there is provided a liquid discharging apparatus including: a liquid discharge head; a tank fluidly connected with the liquid discharge head and including a refill port; and a controller. The controller is configured to perform: estimating an amount of liquid remained in the tank at a point of time of starting a refill of the tank with the liquid; estimating a viscosity of the liquid remained in the tank at the point of time of starting the refill of the tank with the liquid; estimating an amount of the liquid refilled; estimating a viscosity of the liquid refilled; and estimating a viscosity of the liquid, in which the liquid remained in the tank and the liquid refilled are mixed, at a point of time of finishing the refill of the tank with the liquid, based on the estimated amount of the liquid remained in the tank, the estimated viscosity of the liquid remained in the tank, the estimated amount of the liquid refilled, and the estimated viscosity of the liquid refilled.

Herein after, the liquid remained in the tank at the point of time of starting the refill of the tank with the liquid is also referred to "the remained liquid" or "the residual liquid", the liquid refilled into the tank is also referred to "the refilled liquid" or "the refill liquid", and the liquid in which the liquid remained in the tank and the liquid refilled are mixed is also referred to "the mixed liquid". The viscosity of the mixed liquid varies with the amount of the refilled liquid, the refill liquid viscosity, the amount of the remained liquid, and the viscosity of the remained liquid. Therefore, according to the above configuration, the refill amount, the viscosity of the refilled liquid, the amount of the remained liquid, and the viscosity of the remained liquid are estimated, and the mixed liquid viscosity is estimated on the basis thereof.

DESCRIPTION OF THE EMBODIMENT

Hereinbelow, an embodiment of the present teaching will be explained.

<Overall Configuration of a Printer>

Figure 1:
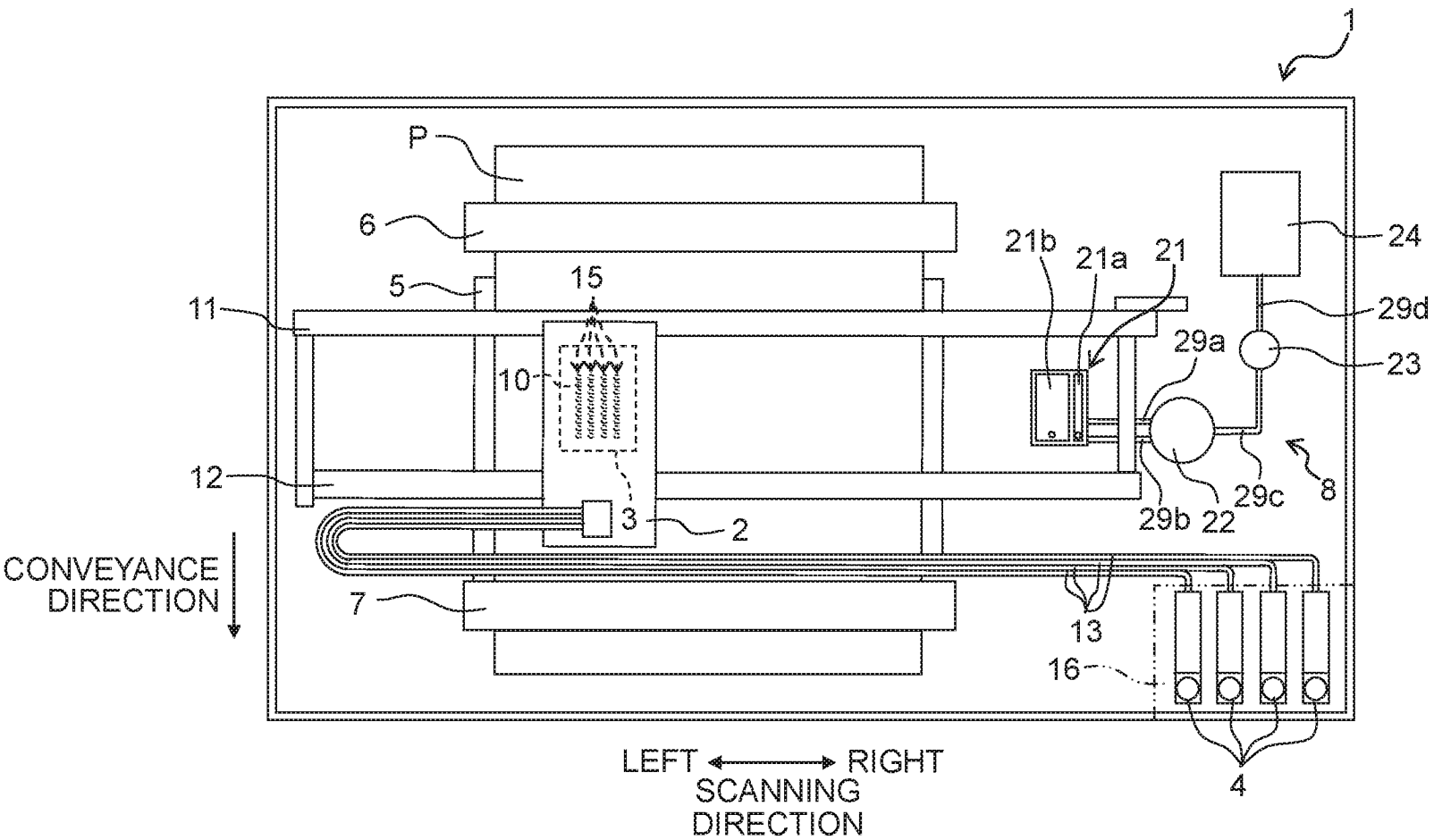
FIG. 1 is a schematic configurational diagram of a printer according to an embodiment of the present teaching.
Figure 2A:
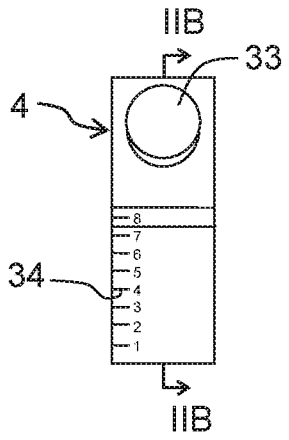
FIG. 2A depicts an ink tank viewed from the downstream side in a conveyance direction, with a tank cap fitted on an ink refill portion.
Figure 2B:
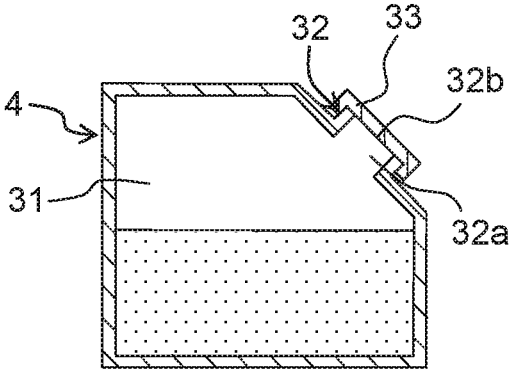
FIG. 2B is a cross-sectional view along the line B-B of FIG. 2A.
Figure 2C:
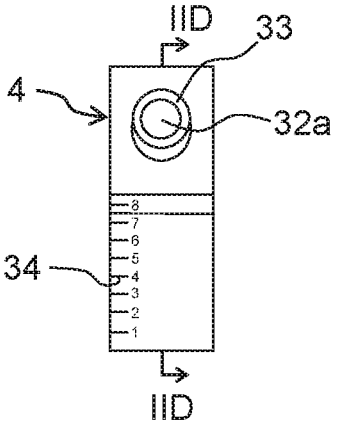
FIG. 2C depicts the ink tank viewed from the downstream side in the conveyance direction, with the tank cap removed from the ink refill portion.
Figure 2D:
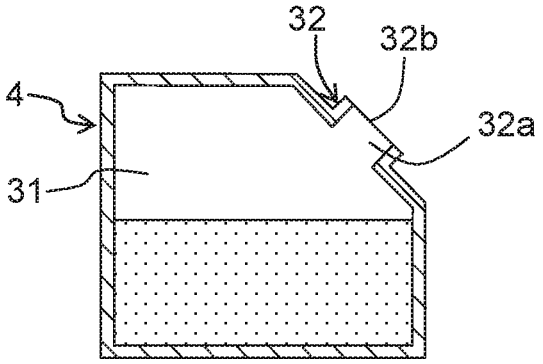
FIG. 2D is a cross-sectional view along the line IID-IID of FIG. 2C.

As depicted in FIG. 1, a printer 1 according to the embodiment (the "liquid discharging apparatus" of the present teaching) includes a carriage 2, an ink jet head 3 (the "liquid discharge head" of the present teaching), four ink tanks 4, a platen 5, conveyance rollers 6 and 7, and a maintenance unit 8.

The carriage 2 is supported by two guide rails 11 and 12 extending in a scanning direction and is movable in the scanning direction. The carriage 2 is connected with a carriage motor 56 via an undepicted belt or the like (see FIG. 3). If the carriage motor 56 is driven, then the carriage 2 moves in the scanning direction along the guide rails 11 and 12. Note that as depicted in FIG. 1, the following explanation will be made with the right side and the left side being defined in the scanning direction.

The ink jet head 3 is mounted on the carriage 2. The ink jet head 3 causes a plurality of nozzles 10 formed in its lower surface to jet inks. To explain in more detail, the plurality of nozzles 10 are arrayed in a conveyance direction orthogonal to the scanning direction to form nozzle rows 15. Further, the ink jet head 3 has four nozzle rows 15 aligning in the scanning direction. A black ink is jetted from the plurality of nozzles 10 forming the rightmost nozzle row 15. Color inks of yellow, cyan and magenta are jetted from the plurality of nozzles 10 forming the left three nozzle rows 15, in the order of those nozzle rows 15 from right to left.

The four ink tanks 4 are provided in such a portion of the printer 1 as at the right side in the scanning direction and on the downstream side in the conveyance direction, to align in the scanning direction. The four ink tanks 4 are connected with the ink jet head 3 via four tubes 13 or the like. The ink tanks 4 retain the inks of black, yellow, cyan and magenta in the order from the right side to the left side. Then, these four color inks retained in the four ink tanks 4 are supplied to the ink jet head 3 via the four tubes 13 or the like. Further, the printer 1 is provided with an openable and closable cover 16 for covering the four ink tanks 4. In printing or the like, the cover 16 is closed such that it is not possible to refill the ink tanks 4 with the inks. If the cover 16 is opened, then the four ink tanks 4 are exposed such that it is possible to refill the ink tanks 4 with the inks as will be described later on. Further, a cover sensor 35 (see FIG. 3) is provided for detecting whether the cover 16 is opened or closed. Further, a detailed explanation will be made later on about a structure and the like of the ink tanks 4.

The platen 5 is arranged below the ink jet head 3 to face the ink jet head 3. The platen 5 supports recording paper P in printing from below. The conveyance roller 6 is arranged on the upstream side from the platen 5 in the conveyance direction. The conveyance roller 7 is arranged on the downstream side from the platen 5 in the conveyance direction. The conveyance rollers 6 and 7 are connected to a conveyance motor 57 (see FIG. 3) via unshown gears or the like. If the conveyance motor 57 is driven, then the conveyance rollers 6 and 7 rotate to convey the recording paper P in the conveyance direction.

The maintenance unit 8 includes a nozzle cap 21 (the "liquid receiver" of the present teaching), a switching unit 22, a suction pump 23, and a waste tank 24. The nozzle cap 21 is arranged at the right side of the platen 5. The nozzle cap 21 has two cap portions 21*a* and 21*b* aligning in the scanning direction, and the cap portion 21*b* is positioned at the left side of the cap portion 21*a*. Further, the nozzle cap 21 is connected with a cap raising and lowering device 58 (see FIG. 3) and thus can be raised and lowered by the cap raising and lowering device 58. Then, if the carriage 2 is moved to a maintenance position at the right side of the platen 5, then the nozzles 10 forming the rightmost nozzle row 15 come to face the cap portion 21*a* while the nozzles 10 forming the left three nozzle rows 15 come to face the cap portion 21*b*. In this state, if the nozzle cap 21 is raised by the cap raising and lowering device 58, then the plurality of nozzles 10 are covered by the nozzle cap 21. In more detail, the nozzles 10 forming the rightmost nozzle row 15 is covered by the cap portion 21*a* while the nozzles 10 forming the left three nozzle rows 15 are covered by the cap portion 21*b*. Note that the "relative motion mechanism" of the present teaching corresponds to a combination of the cap raising and lowering device 58 for raising and lowering the 21, and the device for moving the ink jet head 3 in the scanning direction constructed from the carriage 2, and the carriage motor 56 and the like for moving the carriage 2 in the scanning direction, in this embodiment.

The switching unit 22 is connected with the cap portions 21*a* and 21*b* via tubes 29*a* and 29*b*. Further, the switching unit 22 is connected with the suction pump 23 via a tube 29*c*. The switching unit 22 selectively connects either one of the cap portions 21*a* and 21*b* with the suction pump 23. The suction pump 23 is a tube pump or the like. Further, the suction pump 23 is connected with the waste tank 24 via a tube 29*d* at the other side than the switching unit 22. Note that in this embodiment, a combination of the switching unit 22 and the suction pump 23 corresponds to the "discharge mechanism" of the present teaching.

<Ink Tanks>

Next, the ink tanks 4 will be explained in detail. As depicted in FIGS. 2A to 2D, each ink tank 4 has a cuboid shape and is formed therein with a retainment space 31 for internally retaining the ink. Further, the ink tank 4 is provided with an ink refill portion 32 in an upper end portion of a downstream end portion in the conveyance direction. Inside the ink refill portion 32, a refill flow channel 32*a* is formed in connection with the retainment space 31 and a refill port 32*b* is formed in a fore-end portion of the refill flow channel 32*a*. Further, the ink refill portion 32 is fitted with a tank cap 33 for blocking the refill port 32*b*. Then, by removing the tank cap 33 from the ink refill portion 32, the ink tank 4 can be refilled with the ink into the retainment space 31 from the refill port 32*b*. Further, except when refilling with the ink, with the tank cap 33 being fitted on the ink refill portion 32, it is possible to prevent the ink inside the retainment space 31 from spilling out of the refill port 32*b* and restrain the moisture in the ink inside the retainment space 31 from evaporating from the refill port 32*b*.

Further, the ink tank 4 is made of a synthetic resin material and is semi-transparent. By virtue of this, it is possible for a user to visually recognize the ink retained inside the retainment space 31 from the outside of the ink tank 4. Further, a plurality of calibrations 34 are affixed on an end face of the ink tank 4 on the downstream side in the conveyance direction to align in an up/down direction for the user to grasp the ink amount inside the retainment space 31. Further, the calibrations 34 are assigned respectively with numbers for identification ("1", "2", . . . , "7", and "8" in FIGS. 2B and 2D). Here, with the printer 1, it is possible for the user to visually recognize the calibrations 34 even if the cover 16 is closed, by virtue of the cover 16 being at least partially transparent or the like, for example.

<Controller>

Figure 3:
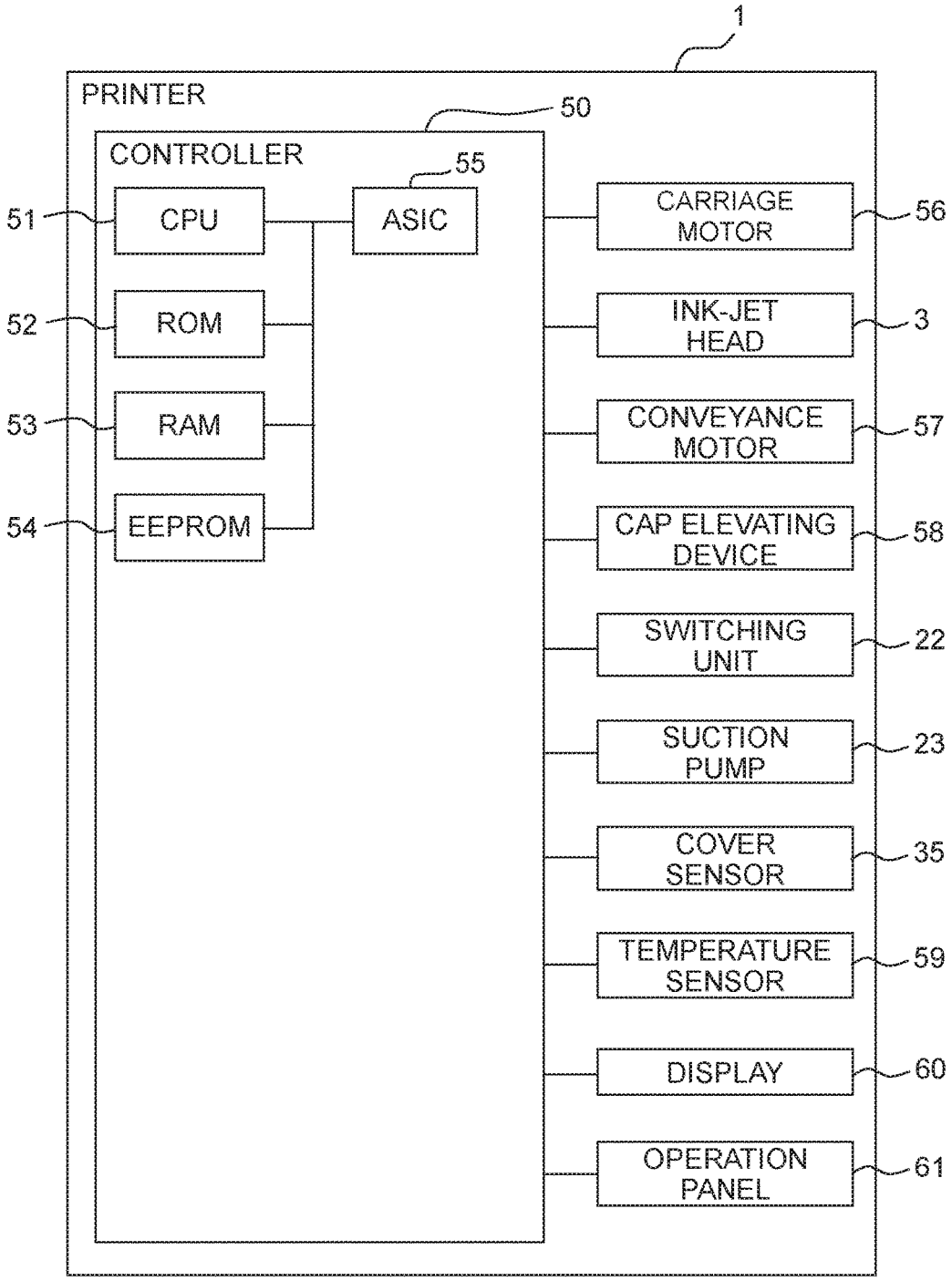
FIG. 3 is a block diagram depicting an electrical configuration of the printer.

Next, an explanation will be made about a controller 50 adapted to control the operation of the printer 1. As depicted in FIG. 3, the controller 50 is composed of a CPU (Central Processing Unit) 51, a ROM (Read Only Memory) 52, a RAM (Random Access Memory) 53, an EEPROM (Electrically Erasable Programmable Read Only Memory) 54, an ASIC (Application Specific Integrated Circuit) 55, and the like. Those components control the operations of the carriage motor 56, the ink jet head 3, the conveyance motor 57, the cap raising and lowering device 58, the switching unit 22, the suction pump 23, and the like. Further, the controller 50 detects whether the cover 16 is opened or closed on the basis of a signal from the cover sensor 35. Further, the printer 1 is provided with a temperature sensor 59. The temperature sensor 59 serves for detecting the ambient temperature around the printer 1. The temperature sensor 59 may directly detect the ambient temperature around the printer. Alternatively, the temperature sensor 59 may indirectly detect the ambient temperature around the printer by detecting the temperature of an object whose temperature changes according to the ambient temperature around the printer. The controller 50 acquires the temperature from the detected result by the temperature sensor 59. Further, the printer 1 is provided with a display unit 60 for the controller 50 to cause the display unit 60 to display necessary information, messages, and the like. Further, the printer 1 is provided with an operation panel 61 (the "refill amount information input unit" of the present teaching). By virtue of this, the user can operate the operation panel 61 to input ink amount and the like inside the ink tanks 4 as will be described later on.

Further, while FIG. 3 depicts only one CPU 51, the controller 50 may either include only one CPU 51 to collectively carry out processes with that one CPU 51 or include a plurality of CPUs 51 to carry out the processes shared by the plurality of CPUs 51. Further, while FIG. 3 depicts only one ASIC 55, the controller 50 may either include only one ASIC 55 to collectively carry out processes with that one ASIC 55 or include a plurality of ASICs 55 to carry out the processes shared by the plurality of ASICs 51. Further, in this embodiment, the ROM 52, RAM 53 and EEPROM 54 for storing information correspond to the "memory" of the present teaching.

<The Control in Refilling with the Inks>

Figure 4A:
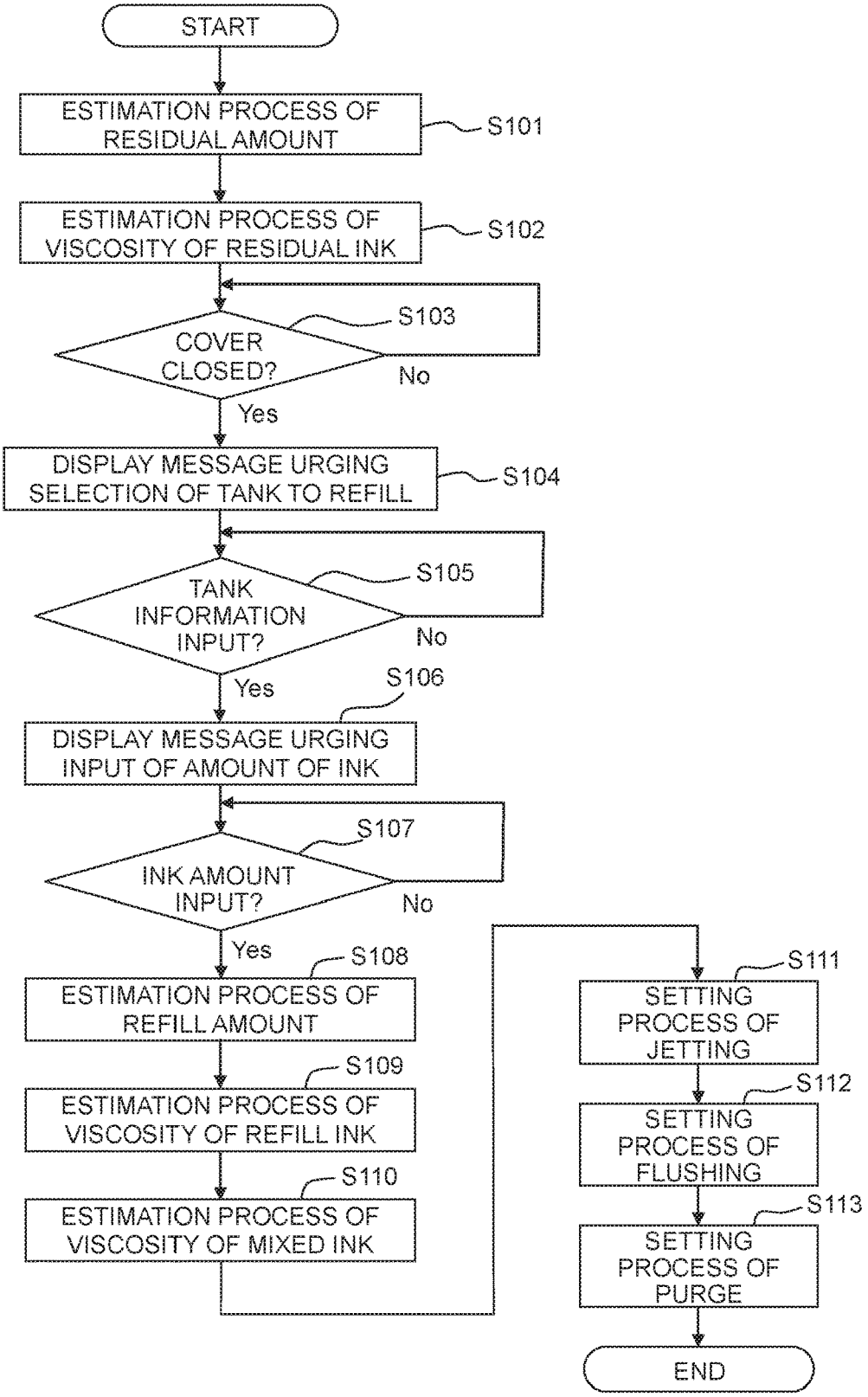
FIG. 4A is a flow chart depicting the flow of a process carried out when the ink tank is refilled with an ink.

Next, an explanation will be made about the control carried out by the controller 50 in refilling the ink tanks 4 with the inks. In refilling each of the ink tanks 4 with the ink, the controller 50 carries out a process following the flow depicted in FIG. 4A. The flow depicted in FIG. 4A starts when the controller 50 detects that the cover 16 is opened on the basis of the signal fed from the cover sensor 35. Note that in the following explanation of each step, the word "step" will be omitted such as the step S101 being referred to simply as S101.

If the cover 16 is opened, then the controller 50 first carries out a residual amount estimation process (S101) to estimate a residual amount Ar of the ink remaining in the ink tank 4 when the ink tank 4 is refilled with the ink (right before the refilling with the ink). Then, the controller 50 carries out a residual ink viscosity estimation process (S102; the "residual liquid viscosity estimation process" of the present teaching) to estimate a residual ink viscosity Vr (the "residual liquid viscosity" of the present teaching) which is the viscosity of the ink remaining in the ink tank 4 when the ink tank 4 is refilled with the ink (right before the refilling with the ink). Later on, detailed explanations will be made about the residual amount estimation process and the residual ink viscosity estimation process.

Next, the controller 50 stands by until the cover 16 is closed when the user is finished with refilling the ink tank 4 with the ink (S103: No). During this time, the user removes the tank cap 33 from the ink refill portion 32, and refills the ink tank 4 with the ink through the refill port 32*b*. Then, after the refilling with the ink, the tank cap 33 is fitted to the ink refill portion 32 and the cover 16 is closed. Then, when the cover 16 is closed (S103: Yes), the controller 50 causes the display unit 60 to display a message urging the selection of the ink tank 4 having been refilled with the ink (S104). The process stands by until the user inputs the information of the ink tank 4 having been refilled with the ink (S105: No). If the information is inputted about the ink tank 4 having been refilled with the ink, then the controller 50 causes the display unit 60 to display a message urging the input of the ink amount in the ink tank 4 (the number of any of "1" to "8" assigned to the calibrations 34, i.e., the "refill amount information" of the present teaching) (S106), and stands by until the user inputs the ink amount (S107: No). If the user inputs the ink amount (S107: Yes), then the controller 50 carries out a refill amount estimation process to estimate an refill amount As of the ink having refilled the ink tank 4, and a refill ink viscosity estimation process (the "refill liquid viscosity estimation process" of the present teaching) to estimate a refill ink viscosity Vs (the "refill liquid viscosity" of the present teaching) which is the viscosity of the ink having refilled the ink tank 4 (S108 and S109). Later on, detailed explanations will be made about the refill amount estimation process and the refill ink viscosity estimation process.

Then, the controller 50 carries out a mixed ink viscosity estimation process (the "mixed liquid viscosity estimation process" of the present teaching) to estimate a mixed ink viscosity Vm (the "mixed liquid viscosity" of the present teaching) which is the viscosity of the ink mixing the ink remaining in the ink tank 4 right before the ink tank 4 is refilled with the ink, with the ink having refilled the ink tank 4, on the basis of the estimated residual amount Ar, residual ink viscosity Vr, refill amount As, and refill ink viscosity Vs (S110). In the step S110, the controller 50 calculates the mixed ink viscosity Vm by using, for example, the relational expression: $Vm=Vr\times[Ar/(Ar+As)]+Vs\times[As/(Ar+As)]$.

Next, the controller 50 carries out a jet setting process (S111). In the jet setting process, the controller 50 sets a drive waveform for driving the ink jet head 3 for printing according to the estimated mixed ink viscosity Vm. For example, the drive waveform for the ink jet head 3 is set such that the higher the mixed ink viscosity Vm, the larger the jet energy applied to the ink in the nozzles 10.

Next, the controller 50 carries out a flushing setting process (S112). In the flushing setting process, the controller 50 sets a frequency for carrying out an aftermentioned in-print flushing process according to the estimated mixed ink viscosity Vm. Here, setting the frequency for carrying out the in-print flushing process is, for example, setting a predetermined number of times Na when carrying out the in-print flushing process at each of the predetermined times Na of carrying out an aftermentioned jetting process to jet the inks to the recording paper P in printing. In this case, if the the mixed ink viscosity Vm is high, the predetermined number of times Na is set to a large value. It is also possible to set such that the predetermined number of times Na may have a larger value as the mixed ink viscosity Vm increases.

Next, the controller 50 carries out a purge setting process (S113). In the purge setting process, the controller 50 sets a frequency (a predetermined time Tp which is a time interval of carrying out a suction purge process) for carrying out the aftermentioned suction purge process during the standby time without printing, according to the estimated mixed ink viscosity Vm. For example, if the mixed liquid viscosity is high, then the predetermined time Tp is set to a short time. It is also possible to set such that the predetermined time Tp may become shorter as the mixed liquid viscosity increases.

<Residual Amount Estimation Process>

Next, the residual amount estimation process S101 will be explained. With respect to the nozzles 10 jetting the black ink (the plurality of nozzles 10 forming the rightmost nozzle row 15), and the nozzles 10 jetting the color inks (the plurality of nozzles 10 forming the left three nozzle rows 15), the controller 50 counts, respectively, the number of times of jetting the ink(s) from the plurality of nozzles 10 in printing and in aftermentioned flushing, from the point of time of finishing the previous refill of the ink tank 4 with the ink, and lets the EEPROM 54 or the like store that information. Further, with respect to the black ink and the color inks, the controller 50 counts, respectively, the number of times of carrying out the aftermentioned suction purge process, from the point of time of finishing the previous refill of the ink tank 4 with the ink, and lets the EEPROM 54 or the like store that information.

Figure 4B:
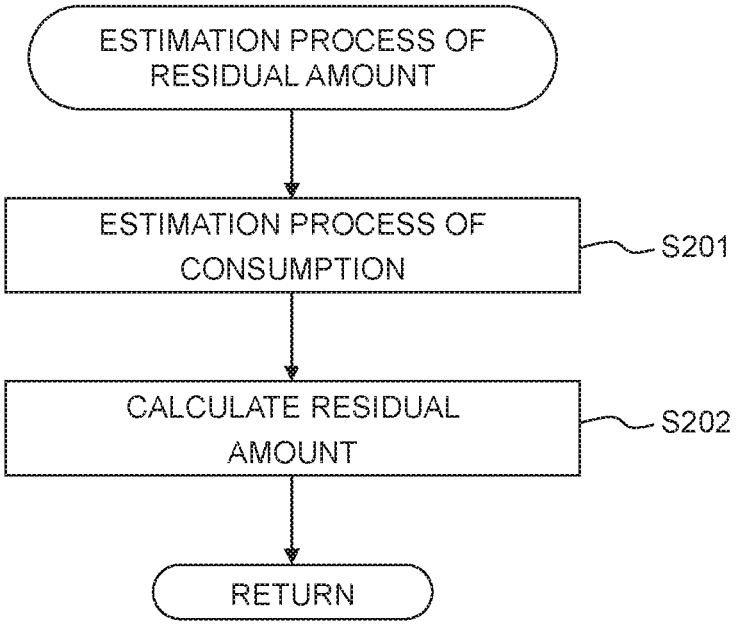
FIG. 4B is a flow chart depicting the flow of a residual amount estimation process in FIG. 4A.

Then, as depicted in FIG. 4B, in the residual amount estimation process S101, the controller 50 carries out a consumption amount estimation process (S201) to estimate the ink consumption amount from the point of time of finishing the previous refill of the ink tank 4 with the ink, based on the number of times stored as described above. Then, the controller 50 calculates the residual amount Ar (S202), based on the difference between the ink amount inputted at the time of the previous refill of the ink tank 4 with the ink (the ink amount corresponding to any of the "1" to "8" assigned to the calibrations 34), and the ink consumption amount estimated in the step S201.

The residual amount Ar is obtained by subtracting the ink consumption amount up to the point of time right before the current refill of the ink tank 4 with the ink, from the ink amount in the ink tank 4 at the time of finishing the previous refill of the ink tank 4 with the ink. Therefore, as described earlier on, it is possible to correctly estimate the residual amount Ar by calculating the residual amount Ar based on the difference between the ink amount in the ink tank 4 at the time of the previous refill of the ink tank 4 with the ink, and the ink consumption amount from the time of the previous refill of the ink tank 4 with the ink.

<Residual Ink Viscosity Estimation Process>

Next, the residual ink viscosity estimation process S102 will be explained. The controller 50 causes the EEPROM 54 to store temperature history information about the temperature history acquired on the basis of a signal fed from the temperature sensor 59. Then, in the residual ink viscosity estimation process S102, the controller 50 estimates the residual ink viscosity Vr, based on the mixed ink viscosity Vm estimated at the time of the previous refill of the ink tank 4 with the ink, and the temperature history information from the point of time of finishing the previous refill of the ink tank 4 with the ink. For example, the controller 50 calculates, from the above temperature history information, an average temperature from the previous refill of the ink tank 4 with the ink to the current retainment of the ink in the ink tank 4, and estimates that the higher the calculated average temperature, the higher the residual ink viscosity Vr. Alternatively, for example, the temperature is acquired periodically on the basis of the signal fed from the temperature sensor 59 during the period from the point of time of finishing the previous refill of the ink tank 4 with the ink to the current retainment of the ink in the ink tank 4 and, at each temperature, the EEPROM 54 stores the number of times of acquiring that temperature. Then, the larger the number of times of acquiring high temperatures, the higher the residual ink viscosity Vr estimated.

The viscosity of the ink in the ink tank 4 is the mixed ink viscosity Vm estimated right after finishing the refill of the ink tank 4 with the ink and, with the passage of time, increases gradually as the moisture in the ink evaporates. Further, at this time, the higher the temperature, the higher the viscosity becomes due to the evaporation of the moisture in the ink. Therefore, as described earlier on, it is possible to correctly estimate the residual ink viscosity Vr by estimating the residual ink viscosity Vr, based on the mixed liquid viscosity estimated at the time of the previous refill of the ink tank 4 with the ink, and the temperature history information from the point of time of finishing the previous refill of the ink tank 4 with the ink. Note that generally the residual ink viscosity is often about 4 to 7 cps.

<Refill Amount Estimation Process>

Next, the refill amount estimation process S108 will be explained. In the refill amount estimation process S108, the controller 50 estimates the refill amount As on the basis of the difference between the inputted ink amount (corresponding to any of the "1" to "8" assigned to the calibrations 34), and the residual amount Ar estimated in the step S101.

The refill amount As is obtained by subtracting the ink residual amount up to the point of time right before the refill of the ink tank 4 with the ink, from the ink amount in the ink tank 4 at the time of finishing the refill of the ink tank 4 with the ink. Therefore, as described earlier on, it is possible to correctly estimate the refill amount As by estimating the refill amount As based on the difference between the ink amount in the ink tank 4 at the time of the refill of the ink tank 4 with the ink, and the residual amount Ar estimated in the step S101.

<Refill Ink Viscosity Estimation Process>

Next, the refill ink viscosity estimation process S109 will be explained. In the refill ink viscosity estimation process S109, the controller 50 estimates the refill ink viscosity Vs on the basis of the detected temperature based on the signal fed from the temperature sensor 59 at the point of time of finishing the refill of the ink tanks 4 with the ink (for example, at the point of time of having closed the cover 16). For example, the higher the temperature detected on the basis of the signal fed from the temperature sensor 59, the lower the refill ink viscosity Vs estimated.

The higher the temperature at the time of refilling the ink tank 4 with the ink, the lower the refill ink viscosity Vs. Therefore, as described earlier on, the refill ink viscosity Vs is estimated on the basis of the temperature detected by the temperature sensor 59 at the point of time of finishing the refill of the ink tanks 4 with the ink. By virtue of this, it is possible to correctly estimate the refill ink viscosity Vs. Note that generally, the refill ink viscosity is often about 4 cps.

Further, as described earlier on, the printer 1 includes the four ink tanks 4, and each of the ink tanks 4 is refilled with the ink individually. Hence, in this embodiment, the controller 50 carries out the process following the flow of FIG. 4A for the four ink tanks 4, individually.

<Process in Printing>

Figure 5:
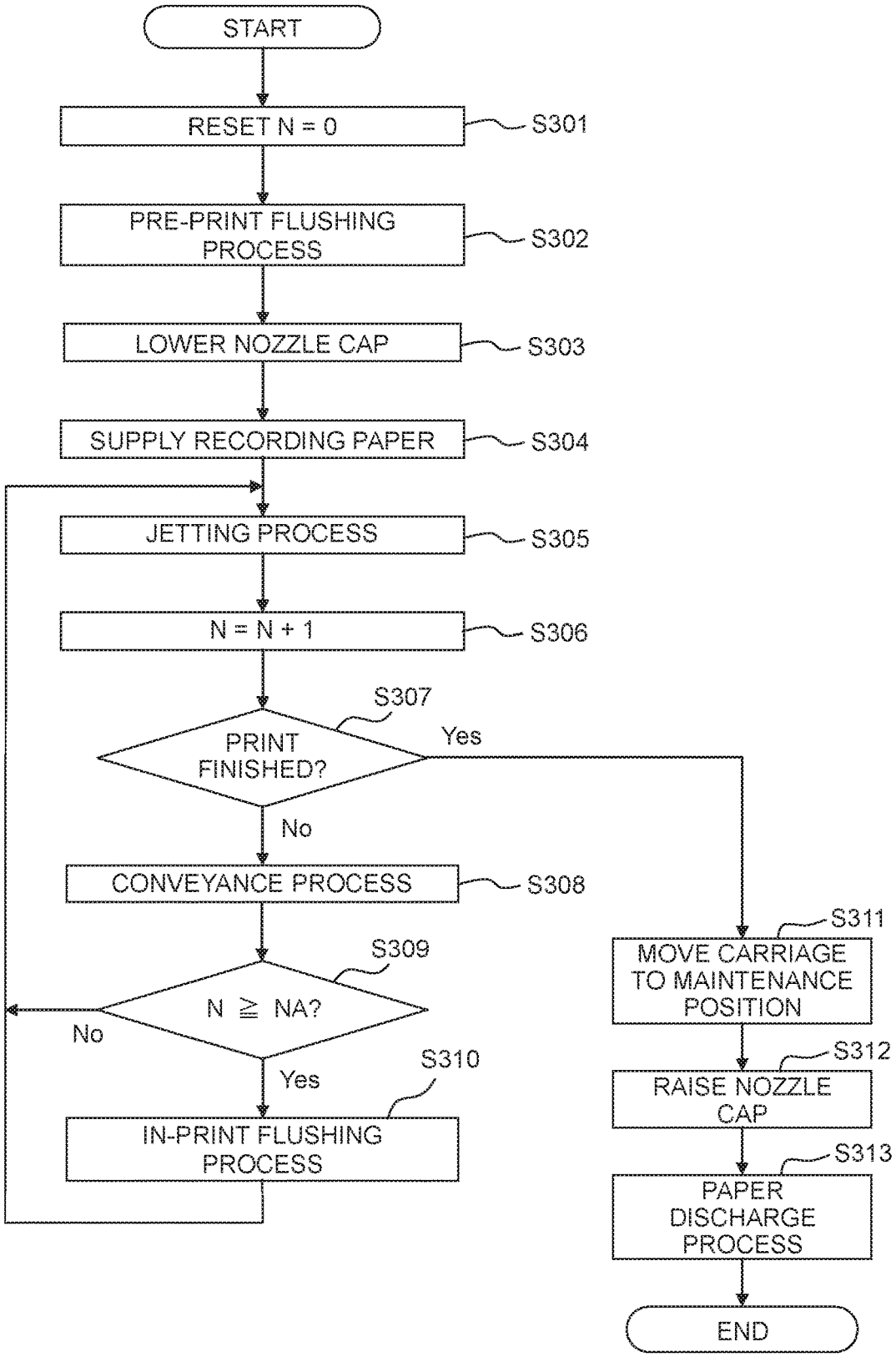
FIG. 5 is a flow chart depicting the flow of a process when the printer is in printing.

Next, an explanation will be made about a control process carried out by the controller 50 when printing is carried out in the printer 1. When a print command is inputted to the printer 1, the controller 50 carries out the process following the flow of FIG. 5. Here, in the printer 1, during the standby time when no printing is carried out, the carriage 2 is located in the maintenance position where the plurality of nozzles 10 are covered by the nozzle cap 21. If the print command is inputted to the printer 1, then the controller 50 first resets 0 to the number of performances N of carrying out the aftermentioned jetting process (S301). Then, the controller 50 carries out a pre-print flushing process (S302). In the pre-print flushing process, a pre-print flushing is carried out such that the ink jet head 3 is driven with the plurality of nozzles 10 covered by the nozzle cap 21, and the inks are discharged from the nozzles 10 to the cap portions 21*a* and 21*b*. Then, the controller 50 controls the cap raising and lowering device 58 to lower the nozzle cap 21 and separate the same from the ink jet head 3 (S303). Further, the sequence may be reversed between the pre-print flushing (S302) and the lowering of the carriage 2 (S303). In such a case, in the pre-print flushing, the inks are discharged from the nozzles 10 to the nozzle cap 21 having separated from the ink jet head 3.

Then, the controller 50 drives an unshown paper feeding device to supply the recording paper P (S304). Further, the steps S302, S303, and S304 may be carried out in the reversed sequence or in parallel.

Then, the controller 50 performs the jetting process (S305), and increases the number of performances N by one (S306). In the jetting process S305, the controller 50 controls the carriage motor 56 to move the carriage 2 in the scanning direction while controlling the ink jet head 3 to jet the inks from the plurality of nozzles 10 to the recording paper P. On this occasion, the controller 50 drives the ink jet head 3 based on the drive waveform set in the step S109.

There is a difference in the ink jet property depending on the viscosity of the inks in the nozzles 10 when the same jet energy is applied to the inks in the nozzles 10. The viscosity of the inks in the nozzles 10 changes with the viscosity of the inks supplied from the ink tanks 4 to the ink jet head 3. Here, in this embodiment, as described earlier on, the drive waveform is set according to the mixed ink viscosity Vm and, in the jetting process, the ink jet head 3 is driven on the basis of the set drive waveform. By virtue of this, in the printing, it is possible to jet the inks appropriately from the nozzles 10 independently from the mixed ink viscosity Vm.

Then, if the printing on the recording paper P has not yet been finished (S307: No), then the controller 50 carries out a conveyance process (S308). In the conveyance process, the controller 50 controls the conveyance motor 57 to cause the conveyance rollers 6 and 7 to convey the recording paper P in the conveyance direction through a predetermined distance (for example, as long as the nozzle rows 15). Then, if the number of performances N of carrying out the jetting process is less than the predetermined number of times Na set in the step S110 (S309: No), then the process returns to the step S305 directly but, if the number of performances N of carrying out the jetting process is the predetermined number of times Na or more, then the process returns to the step S305 after carrying out the in-print flushing process (S310; the "flushing process" of the present teaching). By virtue of this, the in-print flushing process is carried out at each number of times Na of carrying out the jetting process S305.

In the in-print flushing process S310, the controller 50 drives the ink jet head 3 to carry out the in-print flushing process to discharge the inks from the plurality of nozzles 10 to the cap portions 21*a* and 21*b*, after controlling the carriage motor 56 to move the carriage 2 to the maintenance position. By virtue of this, ink thickening in the nozzles 10 is prevented.

The appropriate frequency for carrying out the in-print flushing differs depending on the viscosity of the inks supplied from the ink tanks 4 to the ink jet head 3. Here, in this embodiment, as described earlier on, the in-print flushing process is carried out at such a frequency (at each number of times Na of carrying out the jetting process) as (the predetermined number of times Na) set for carrying out the in-print flushing process according to the mixed ink viscosity Vm. By virtue of this, it is possible to carry out the in-print flushing at an appropriate frequency independently from the mixed ink viscosity Vm.

On the other hand, if the printing is finished (S307: Yes), then the controller 50 controls the cap raising and lowering device 58 to raise the nozzle cap 21 to cover the plurality of nozzles 10 with the nozzle cap 21 (S312) after controlling the carriage motor 56 to move the carriage 2 to the maintenance position (S311). Then, the controller 50 controls the conveyance motor 57 to let the conveyance roller 7 discharge the recording paper P finished with the printing (S313). Further, the steps S311, S312, and S313 may be carried out in the reversed sequence or in parallel.

<Standby Time Process>

Next, an explanation will be made about a control carried out by the controller 50 during a standby time when the printer 1 does not carry out printing. In the standby time, the controller 50 carries out a process following the flow of FIG. 6. The flow of FIG. 6 starts at the time of plugging in the printer 1, or at the time of finishing the process of printing (ending the flow of FIG. 5).

Figure 6:
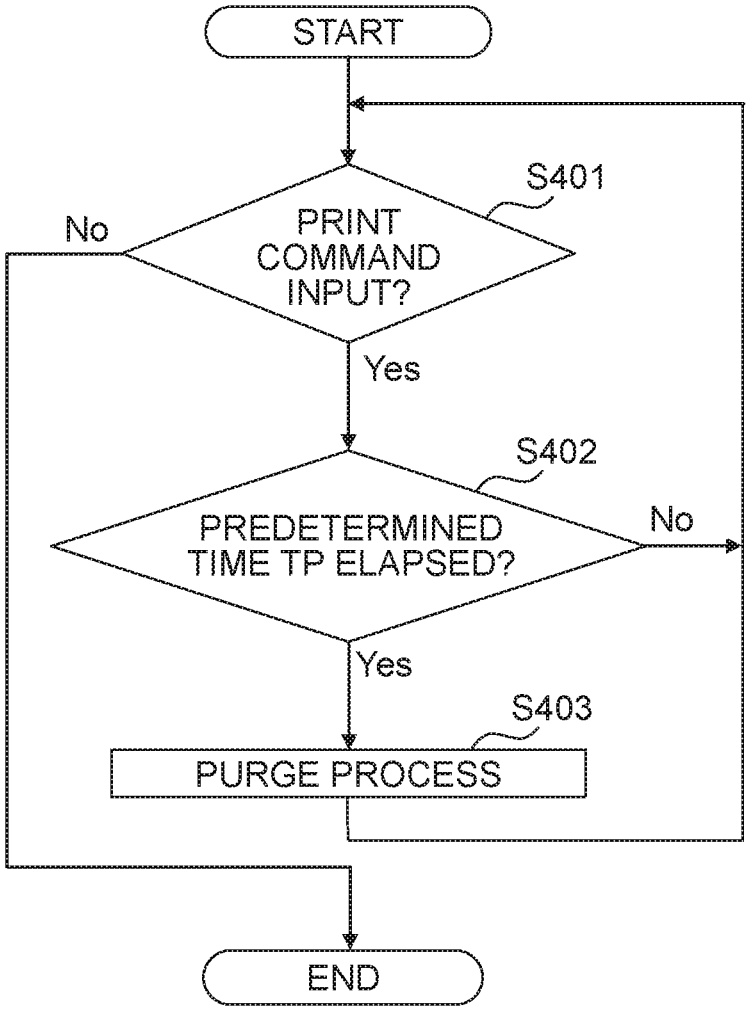
FIG. 6 is a flow chart depicting the flow of a process when the printer is in standby.

In the printer 1, during the standby time as depicted in FIG. 6, the controller 50 repetitively carries out the process of the steps S402 and S403 (S401: No) until a print command is inputted and, if the print command is inputted (S401: Yes), then the process is ended. In the step S402, the controller 50 judges whether or not the predetermined time Tp set in the step S111 has elapsed. Then, the controller 50 stands by if the predetermined time Tp has not elapsed (S402: No), but carries out a purge process (S403) if the predetermined time Tp has elapsed (S402: Yes).

In the purge process, the controller 50 drives the suction pump 23 after connecting the cap portion 21*a* with the suction pump 23, to carry out a suction purge for the black ink to forcibly discharge the black ink in the ink jet head 3 from the nozzles 10 forming the rightmost nozzle row 15. Then, the controller 50 drives the suction pump 23 after connecting the cap portion 21*b* with the suction pump 23, to carry out a suction purge for the color inks to forcibly discharge the color inks in the ink jet head 3 from the nozzles 10 forming the left three nozzle rows 15. Then, by carrying out such suction purges, it is possible to discharge the thickened inks in the ink jet head 3. The inks discharged by the suction purges are retained in the waste tank 24.

The appropriate frequency for carrying out the suction purge process during the standby time differs depending on the viscosity of the inks supplied from the ink tanks 4 to the ink jet head 3. Here, in this embodiment, as described earlier on, the suction purge process is carried out at such a frequency (at each time when the predetermined time Tp has elapsed) as (the predetermined time Tp) set for carrying out the suction purge process during the standby time according to the mixed ink viscosity Vm. By virtue of this, it is possible to carry out the suction purge at an appropriate frequency independently from the mixed ink viscosity Vm.

Next, explanations will be made about modified embodiments applying various changes and/or modifications to the above embodiment.

The method for estimating the residual amount Ar in the residual amount estimation process, and the method for estimating the refill amount As in the refill amount estimation process are not limited to those of the embodiment described above.

For example, differently from the embodiment described above, the ink tank 4 may be refilled with the ink to such an extent that the ink retainment amount in the ink tank 4 reaches the maximum storage volume, instead of inputting the ink retainment amount in the ink tank 4 after the ink tank 4 is finished with the refill of the ink. Then, in the residual amount estimation process, the residual amount Ar may be estimated on the basis of the difference between the maximum storage volume and the consumption amount estimated in the step S201. Further, in this case, in the refill amount estimation process, the refill amount As may be estimated on the basis of the difference between the maximum storage volume and the estimated residual amount Ar.

Figure 7A:
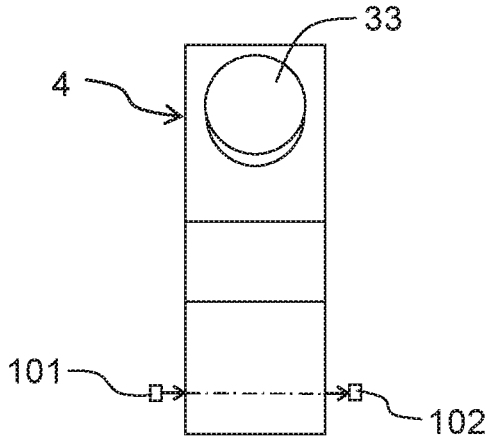
FIG. 7A corresponds to FIG. 2A, according to a first modified embodiment.

Alternatively, for example, in a first modified embodiment, as depicted in FIG. 7A, the ink tank 4 is provided with a light emitting element 101 and a light receiving element 102. The light emitting element 101 and the light receiving element 102 face each other in the scanning direction across a lower end portion of the ink tank 4. The light emitting element 101 radiates light toward the light receiving element 102.

If the ink residual amount in the ink tank 4 is more than a predetermined residual amount such that the ink level is positioned above the light emitting element 101 and the light receiving element 102, then the light radiated from the light emitting element 101 is blocked by the ink in the ink tank 4, so as not to reach the light receiving element 102. On the other hand, if the ink residual amount in the ink tank 4 is less than the predetermined residual amount such that the ink level is positioned below the light emitting element 101 and the light receiving element 102, then the light radiated from the light emitting element 101 reaches the light receiving element 102. If the light receiving element 102 receives the light from the light emitting element 101, then the controller 50 detects that the ink residual amount in the ink tank 4 is less than the predetermined residual amount. Further, in the first modified embodiment, the combination of the light emitting element 101 and the light receiving element 102 corresponds to the "small residual amount detecting sensor" of the present teaching.

Then, in the first modified embodiment, if the ink residual amount in the ink tank 4 becomes less than the predetermined residual amount such that the light receiving element 102 has received the light, then the controller 50 causes the display unit 60 to display a message urging the user to refill the ink tank 4 with the ink. Then, on this occasion, in the residual amount estimation process, the residual amount Ar is estimated as the above predetermined residual amount.

If the ink residual amount in the ink tank 4 is detected as less than the predetermined residual amount and the display unit 60 is displaying the message urging the refilling with the ink, then the ink tank 4 is refilled with the ink in such a state that the ink residual amount in the ink tank 4 is approximately the above predetermined residual amount. Therefore, in such a case, it is possible to correctly estimate the residual amount Ar by estimating that the residual amount Ar is the above predetermined residual amount.

Figure 7B:
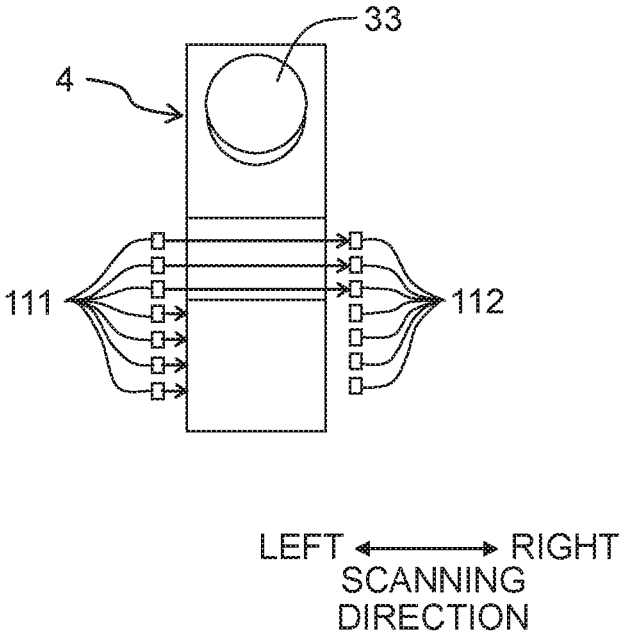
FIG. 7B corresponds to FIG. 2A, according to a second modified embodiment.

Further, according to a second modified embodiment, as depicted in FIG. 7B, the ink tank 4 is provided with a plurality of light emitting elements 111 and a plurality of light receiving elements 112. The plurality of light emitting elements 111 are positioned at the left side of the ink tank 4 to align in the up/down direction. The plurality of light receiving elements 112 are configured to correspond to the plurality of light emitting elements 111 and positioned at the right side of the ink tank 4 to align in the up/down direction. By virtue of this, the light emitting elements 111 and the light receiving elements 112 correspond to each other and face each other in the scanning direction across the ink tank 4.

Then, with the group formed of each light emitting element 111 and the corresponding light receiving element 112, if the ink level in the ink tank 4 is positioned above the light emitting element 111 and light receiving element 112, then the light radiated from the light emitting element 111 is blocked by the ink in the ink tank 4 so as not to reach the light receiving element 112. On the other hand, if the ink level in the ink tank 4 is positioned below the light emitting element 111 and light receiving element 112, then the light radiated from the light emitting element 111 reaches the light receiving element 112. Based on which light receiving element 112 receives the light from the corresponding light emitting element 111 among the plurality of light receiving elements 112, the controller 50 detects the ink retainment amount in the ink tank 4. Further, in the second modified embodiment, the combination of the plurality of light emitting elements 111 and the plurality of light receiving elements 112 corresponds to the "sensor configured to detect an amount of liquid stored in the tank" of the present teaching.

Then, according to the second modified embodiment, in the residual amount estimation process, the residual amount Ar is estimated on the basis of the ink retainment amount in the ink tank 4 detected, as described earlier on, right before the ink is retained in the ink tank 4. Further, in the refill amount estimation process, the refill amount As is estimated on the basis of the difference between the residual amount Ar, and the ink retainment amount in the ink tank 4 detected, as described earlier on, right after the ink is retained in the ink tank 4. Alternatively, in the refill amount estimation process, the refill amount As may be estimated on the basis of the difference between the ink retainment quantities in the ink tank 4 detected, as described above, right before and right after the ink is retained in the ink tank 4.

Further, in the embodiment described above, the refill amount As is estimated on the basis of the difference between the residual amount Ar, and the user-inputted ink amount in the ink tank 4 when the ink tank 4 is finished with the ink refill. However, without being limited to that, the user may input information corresponding to the ink refill amount itself, and the refill amount may be estimated on the basis of the inputted information in the refill amount estimation process. For example, if calibrations indicating the ink amount are provided on a bottle filled with the ink for refilling the ink tank 4, then right before the ink tank 4 is refilled with the ink, and right after the ink tank 4 is refilled with the ink, respectively, the ink amount in the bottle (the "refill amount information" of the present teaching) may be inputted on the basis of the above calibrations, so as to estimate the refill amount As on the basis of the difference between those two ink quantities. Alternatively, if the ink tank 4 is refilled with all the ink in the bottle at one time, then the user may input information about the type of the bottle (the "refill amount information" of the present teaching), so as to estimate the refill amount As on the basis of the inputted type of the bottle.

Figure 8:
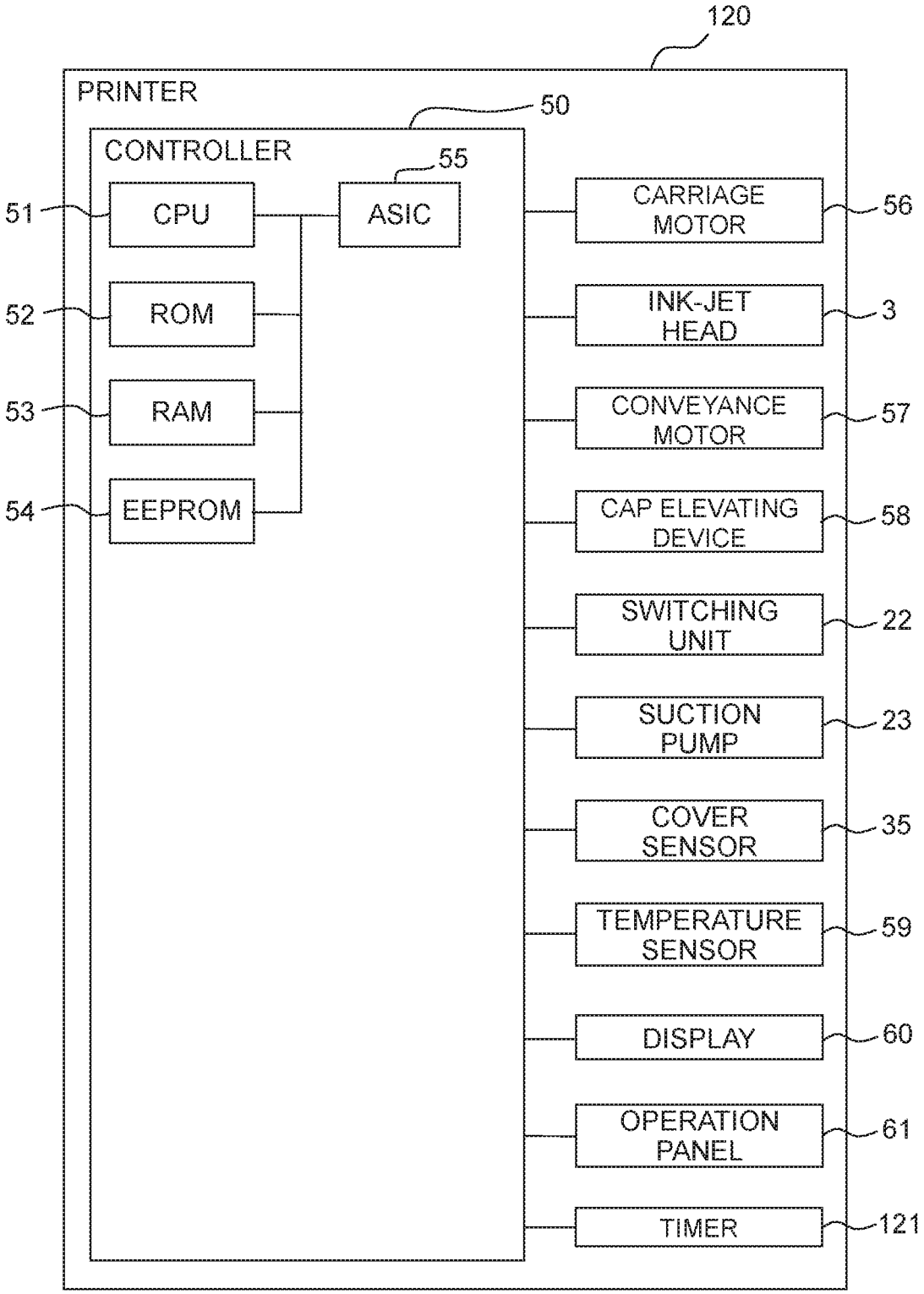
FIG. 8 is a block diagram corresponding to FIG. 3, according to a third modified embodiment.

Further, the method for estimating the residual ink viscosity Vr is not limited to that of the embodiment described above. For example, in a third modified embodiment, as depicted in FIG. 8, a printer 120 further includes a timer 121 (the "timer" of the present teaching). The timer 121 starts measuring time when the ink tank 4 is finished with the ink refill (for example, when the cover 16 is closed). When the ink tank 4 is newly refilled with the ink (for example, when the cover 16 is opened), the controller 50 acquires the elapsed time from the point of time of finishing the previous refill of the ink tank 4 with the ink on the basis of the measured result of the timer 121. Then, in the residual ink viscosity estimation process, the residual ink viscosity Vr is estimated on the basis of the above elapsed time, and the mixed ink viscosity Vm estimated at the time of the previous refill of the ink tank 4 with the ink. In particular, for the same mixed ink viscosity Vm estimated at the time of the previous refill of the ink tank 4 with the ink, the longer the above elapsed time, the higher the residual ink viscosity Vr estimated.

With respect to the ink in the ink tank 4, the viscosity at the point of time of finishing the refill of the ink tank 4 with the ink is the mixed ink viscosity Vm estimated at that time. Thereafter, with the passage of time, the viscosity increases gradually as the moisture in the ink evaporates. Therefore, as described earlier on, it is possible to correctly acquire the residual ink viscosity Vr by estimating the residual ink viscosity Yr.

Further, the method for estimating the refill ink viscosity Vs in the refill ink viscosity estimation process is not limited to that of the embodiment described above. For example, if the ink tank 4 is refilled with the ink in a bottle filled with the ink, then when the ink tank 4 is refilled with the ink, by causing the display unit 60 to display a message urging the input of information of the manufacturing date printed on the bottle, information of the serial number, and the like, the user may input those pieces of information. Then, in the refill ink viscosity estimation process, the refill ink viscosity Vs may be estimated on the basis of the above inputted information.

If the ink in the bottle for refilling the ink tank 4 is in storage over a long time, then the moisture in the ink is subjected to evaporation such that the viscosity increases. Here, as described earlier on, the information of the date of manufacturing the bottle, the information of the serial number, and the like are inputted and, based on those inputted pieces of information, the refill ink viscosity Vs is estimated. By virtue of that, it is possible to correctly estimate the refill ink viscosity Vs by taking into consideration the evaporation of the moisture in the bottled ink. Note that the refill ink viscosity Vs may also be estimated on the basis of both the temperature when the ink tank 4 is refilled with the ink, and the information inputted in the above manner.

Alternatively, for example, if the bottle filled with the ink is unused and vacuum-packed or the like, then the moisture in the bottled ink will almost not evaporate. Hence, in such a case, the refill ink viscosity Vs may be estimated as the ink viscosity at the time of manufacturing the bottle on the basis of the inputted information, regarding that there is no evaporation of the moisture in the bottled ink.

Further, the residual amount estimation process and the residual ink viscosity estimation process, as well as the refill amount estimation process and the refill ink viscosity estimation process, may be carried out in the opposite sequence to that in the embodiment described above, or be carried out in parallel. Further, the residual amount estimation process and the residual ink viscosity estimation process may be carried out after the ink tank 4 is finished with a refill with the ink (after the cover 16 is closed). In this case, the residual amount estimation process, the residual ink viscosity estimation process, the refill amount estimation process, and the refill ink viscosity estimation process may be carried out in a different sequence from that in the embodiment described above, or at least some of the processes may be carried out in parallel. However, among those processes, if the estimated result from a certain process is used in another estimation process for carrying out the estimation, then the other process needs to be carried out after the above certain process.

Further, in the embodiment described above, the jet setting process, the flushing setting process, and the purge setting process are carried out constantly on the basis of the mixed ink viscosity Vm estimated in the mixed ink viscosity estimation process. However, without being limited to that, in a fourth modified embodiment, the controller 50 causes the EEPROM 54 to store the number of refills C of the ink tank 4 with the ink up to now (the "number of refills information" of the present teaching). Then, in the fourth modified embodiment, when the ink tank 4 is refilled with the ink, a process is carried out following the flow depicted in FIG. 9.

To explain in more detail, in the same manner as in the steps S101 to S106, the controller 50 first carries out the steps S501 to S506. Next, the controller 50 carries out a first refill amount estimation process (S509) if the user inputs an ink amount (S507: Yes) before a predetermined time has elapsed (S508: No). The first refill amount estimation process is the same as, for example, the refill amount estimation process S108.

On the other hand, if the user has not inputted any ink amount (S507: No) but the predetermined time has elapsed (S508: Yes), then the controller 50 carries out a second refill amount estimation process (S510). The second refill amount estimation process is, for example, to estimate the refill amount As, as described earlier on, regarding the ink in the ink tank 4 as retained up to the maximum storage volume.

Then, after the first refill amount estimation process and the second refill amount estimation process, the controller 50 then carries out the steps S511 and S512 in the same manner as the steps S109 and S110. Then, the controller 50 increases the number of refills C by one (S513), and judges whether or not the number of refills C exceeds a predetermined number of refills Cm (S514). If the number of refills C does not exceed the predetermined number of refills Cm (S514: No), then the steps S516 to S518 are carried out in the same manner as the steps S111 to S113 on the basis of the mixed ink viscosity Vm estimated in the step S510. On the other hand, if the number of refills C exceeds the predetermined number of refills Cm (S514: Yes), then the controller 50 carries out a correction process (S515) to correct the mixed ink viscosity Vm estimated in the step S512 and, based on the corrected mixed liquid viscosity, carries out the steps S516 to S518 in the same manner as the steps S111 to S113.

Figure 10:
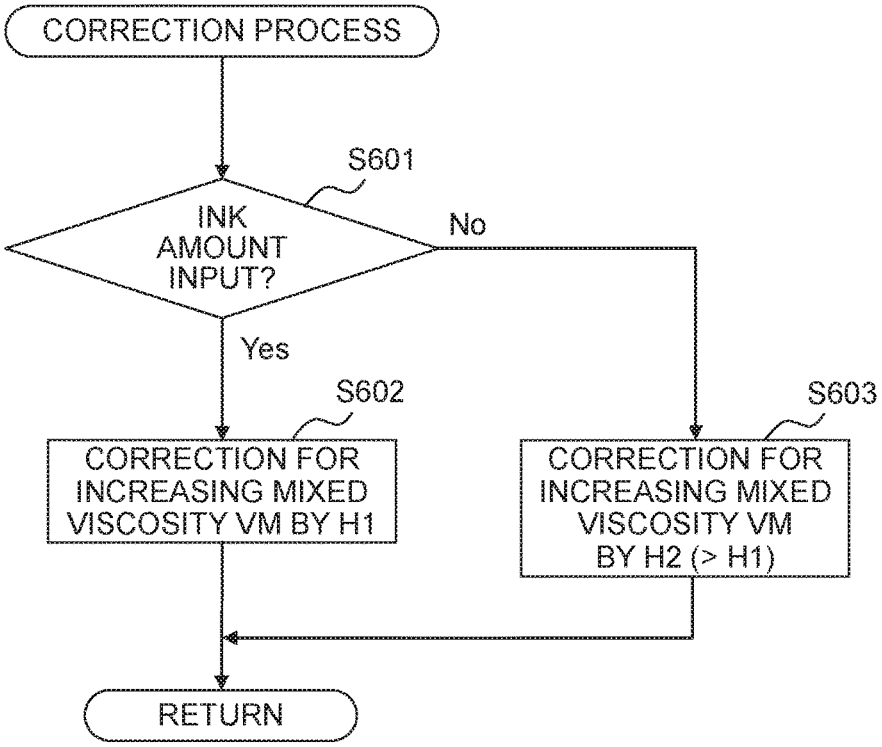
FIG. 10 is a flow chart depicting the flow of a correction process in FIG. 9B.

In the correction process S515, as depicted in FIG. 10, if the display unit 60 displays a message urging the user to input an ink amount in the step S506 and if the user has inputted the ink amount (S601: Yes), then the mixed ink viscosity Vm estimated in the step S512 is corrected in such a manner as increased by a first correction value H1 (S602). On the other hand, if the display unit 60 displays the message urging the user to input an ink amount and if the user has not inputted the ink amount (S601: No), then the mixed ink viscosity Vm estimated in the step S512 is corrected in such a manner as increased by a second correction value H2 (S603).

The more repeatedly the ink tank 4 is refilled with the ink, the higher the possibility of a deviation of the estimated mixed ink viscosity Vm from the actual mixed liquid viscosity. If the estimated mixed ink viscosity Vm is lower than the actual mixed liquid viscosity, then the in-print flushing and/or the suction purge are/is not carried out at a sufficient frequency such that defection is liable to occur in jetting the ink from the nozzles 10. Therefore, in the present teaching, if the number of refills C of the ink tank 4 with the ink exceeds the predetermined number of refills Cm, then the estimated mixed ink viscosity Vm is increased in the correction. By virtue of this, even though the in-print flushing and/or the suction purge may be carried out at a frequency higher than necessary, it is still possible to prevent the defection from occurring in jetting the ink from the nozzles 10 due to insufficient performance of the in-print flushing and/or suction purge.

Further, after the ink tank 4 is finished with the ink refill, if the ink amount is inputted, then the estimated refill amount As has a higher reliability than the case of not inputting the ink amount and, based on that, the estimated mixed ink viscosity Vm also has a higher reliability. Here, in the fourth modified embodiment, if the ink amount is inputted, then the mixed ink viscosity Vm is corrected with a smaller amount in the correction process than the case of not inputting the ink amount. By virtue of this, it is possible to restrain, as much as possible, the mixed ink viscosity Vm from excessive correction.

Figure 9A:
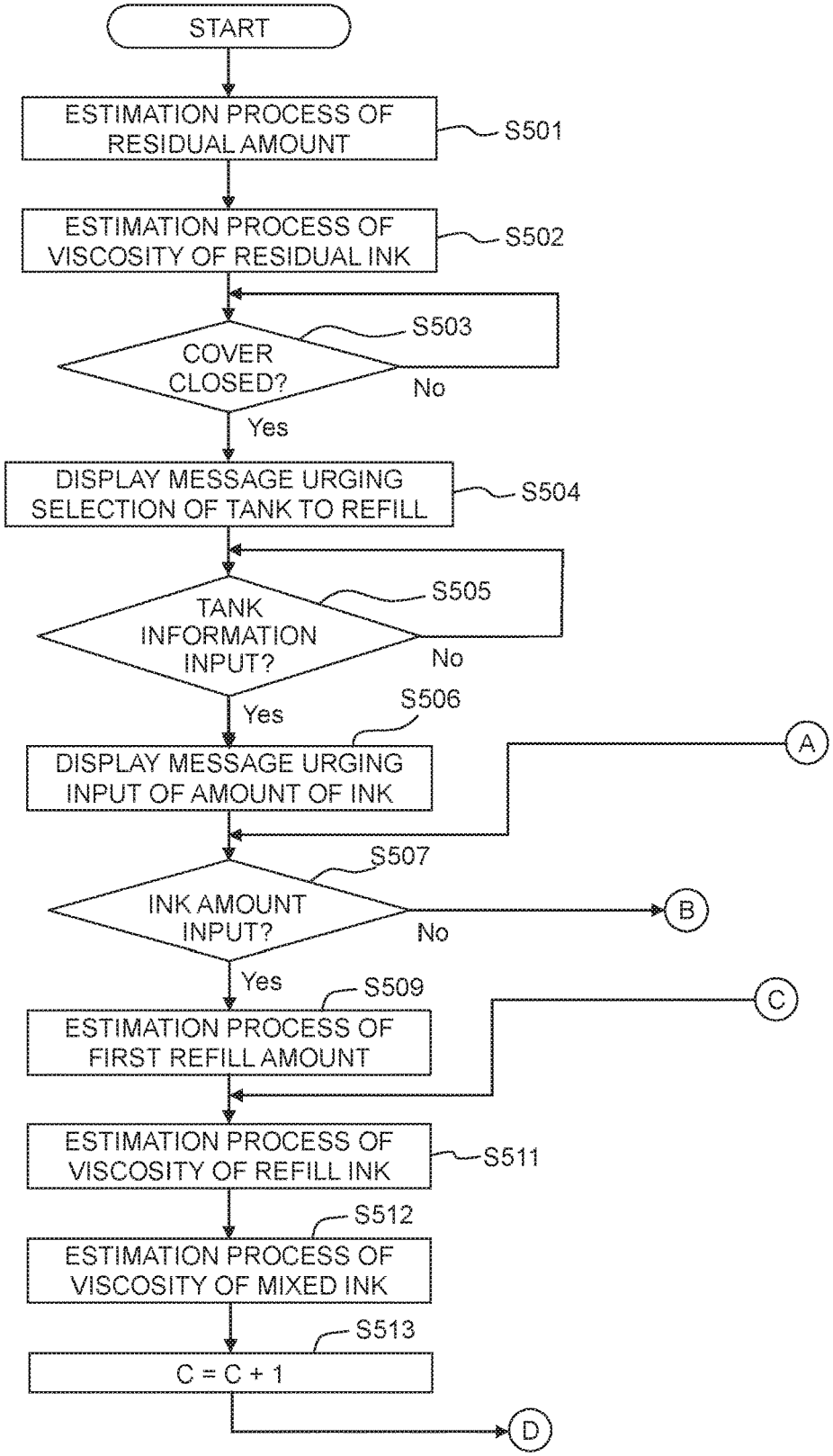
FIG. 9A and FIG. 9B are flow charts corresponding to FIG. 4A, according to a fourth modified embodiment.
Figure 9B:
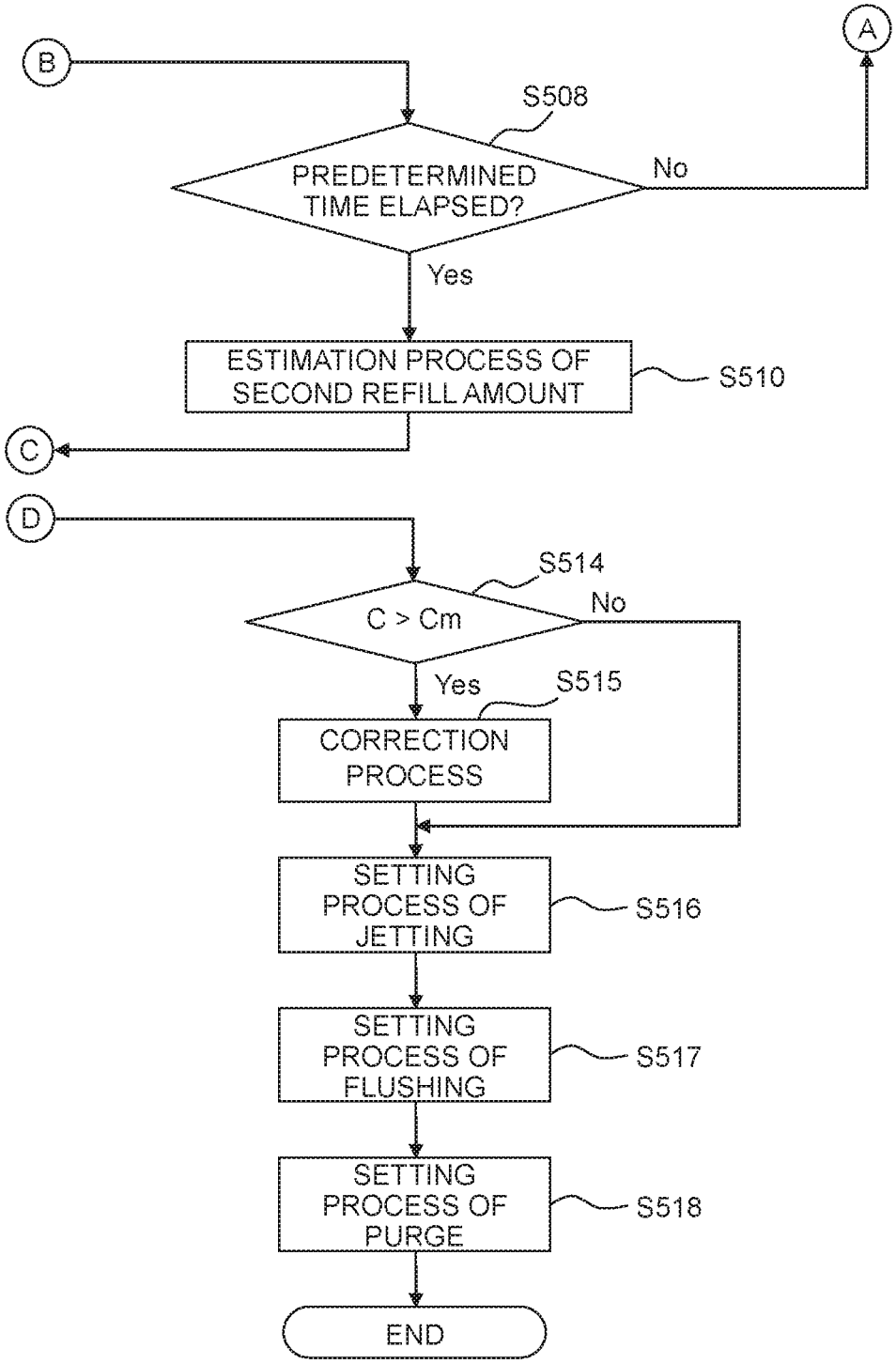

Note that in the fourth modified embodiment, either the signal sent from the cover sensor 35 to the controller 50 when the cover 16 is opened or the signal sent from the cover sensor 35 to the controller 50 when the cover 16 is closed corresponds to the "signal related to the refill of the tank with the liquid" of the present teaching, and the controller 50 increases the number of refills C (updates the number of refills information) at each time of the above signal being inputted, by carrying out the process following the flow of FIG. 9.

Further, in the fourth modified embodiment, after the ink tank 4 is refilled with the ink, the mixed ink viscosity Vm is corrected with a different correction amount in the correction process, depending on whether or not the ink amount is inputted. However, without being limited to that, after the ink tank 4 is refilled with the ink, the mixed ink viscosity Vm may be corrected with the same amount independently from whether or not the ink amount is inputted.

Further, in the fourth modified embodiment, corresponding to the different correction amount for the mixed ink viscosity Vm depending on whether or not the ink amount is inputted, after the ink tank 4 is refilled with the ink, either the first refill amount estimation process or the second refill amount estimation process is carried out selectively depending on whether or not the ink amount is inputted before the predetermined time has elapsed. However, without being limited to that, if the mixed ink viscosity Vm is corrected with the same amount, then in the same manner as in the embodiment described above, for example, the process may stand by until the ink amount is inputted.

Further, in the fourth modified embodiment, if the number of refills C exceeds the predetermined number of refills Cm, then after the ink tank 4 is refilled with the ink, even when the ink amount is inputted, the mixed ink viscosity Vm is still corrected. However, without being limited to that, as described earlier on, if the ink amount is inputted, then the estimated mixed ink viscosity Vm has a higher reliability. Therefore, even if the number of refills C exceeds the predetermined number of refills Cm, after the ink tank 4 is refilled with the ink, when the ink amount is inputted, the estimated mixed ink viscosity Vm may not be corrected.

Further, in the fourth modified embodiment, after the ink tank 4 is refilled with the ink, the number of refills C is increased by one independently from whether or not the ink amount is inputted. However, without being limited to that, for example, after the ink tank 4 is refilled with the ink, the number of refills C may be increased by one only if the ink amount is not inputted.

Further, in the third modified embodiment, the EEPROM 54 stores the number of refills C itself. However, without being limited to that, for example, the EEPROM 54 may store a parameter value with the initial value being the maximum number of refills set to correspond to the product life of the printer and, at each time of refilling the ink tank 4 with the ink, the parameter value may be decreased by one (to update the parameter value). In such a case, the correction process may be carried out when the number of refills C of the ink tank 4 with the ink is acquired from the difference between the initial value and the current value of the above parameter, and the number of refills C exceeds the predetermined number of refills Cm. Further, in this case, the parameter stored in the EEPROM 54 corresponds to the "number of refills information" of the present teaching.

Further, in the embodiment described above, in the jet setting process, based on the mixed ink viscosity Vm, the drive waveform to the ink jet head 3 is set for the jetting process. However, without being limited to that, for example, in the jet setting process, based on the mixed ink viscosity Vm, a drive voltage to the ink jet head 3 may be set for the jetting process. In such a case, for example, the higher the mixed ink viscosity Vm, the higher the drive voltage to the ink jet head 3 is set. In this case, too, it is possible to appropriately jet the inks to the recording paper P from the nozzles 10 independently from the mixed ink viscosity Vm.

Further, in the embodiment described above, the refill ink viscosity is estimated. However, the present teaching is not necessarily limited to such a configuration. For example, the refill ink viscosity may be taken as a constant for which a predetermined value may be used. For example, it is possible to use the ink viscosity in manufacturing the bottle as the predetermined value. Then, based on the residual amount, the residual liquid viscosity and the refill amount estimated according to the aforementioned residual amount estimation process, residual ink viscosity estimation process, and refill amount estimation process, it is possible to carry out the aforementioned mixed liquid viscosity estimation process. On this occasion, by preparing a table in advance to indicate a relationship between the three parameters (the residual amount, the residual liquid viscosity, and the refill amount), it is also possible to estimate the mixed liquid viscosity based on the table.

Further, in the embodiment described above, in the flushing setting process, based on the mixed ink viscosity Vm, the frequency for the in-print flushing is set. However, without being limited to that, for example, in the flushing setting process, based on the mixed ink viscosity Vm, the drive waveform and/or the drive voltage to the ink jet head 3 may be set for the flushing (the pre-print flushing and the in-print flushing). In such a case, for example, the higher the mixed ink viscosity Vm, the higher the jet energy which is exerted by the drive waveform set to the ink jet head 3 and applied to the inks in the nozzles 10. Alternatively, the higher the mixed ink viscosity Vm, the higher the drive voltage set to the ink jet head 3.

The ink amount discharged from the nozzles 10 when the jet energy is applied to the inks in the nozzles 10 differs according to viscosity of the inks supplied to the ink tanks 4 to the ink jet head 3. With respect to that, as described above, based on the mixed ink viscosity Vm, if the drive waveform or the drive voltage is set to the ink jet head 3 for the flushing, then regardless of the mixed ink viscosity Vm, it is possible to discharge an appropriate amount of the inks from the nozzles 10 in the flushing.

Further, in the embodiment described above, in the pre-print flushing and the in-print flushing, the inks are discharged from the nozzles 10 to the cap portions 21*a* and 21*b*. However, without being limited to that, for example, it is allowable to provide a flushing foam made of a material capable of absorbing the inks such as sponge or the like (the "liquid receiver" of the present teaching) in addition to the nozzle cap 21 and, in the pre-print flushing and the in-print flushing, to discharge the inks from the nozzles 10 to the flushing foam after moving the carriage 2 to a position for the nozzles 10 to face the flushing foam. Alternatively, instead of the flushing foam, such a casing may be arranged as to have an opening larger than the area where the plurality of nozzles 10 of the ink jet head 3 are arranged, and such a foam may be arranged in the casing as capable of absorbing the inks. In this case, in the flushing, after the carriage 2 is moved to a position for the nozzles 10 to face the opening of the casing, the inks may be discharged from the nozzles 10 to the opening of the casing.

Further, in the embodiment described above, in the purge setting process, based on the mixed ink viscosity Vm, the frequency is set for the suction purge in the standby time. However, without being limited to that, for example, in the purge setting process, based on the mixed ink viscosity Vm, a drive time may be set for the suction pump 23 with the suction purge. In this case, for example, the higher the mixed ink viscosity Vm, the longer the drive time is set for the suction pump 23.

In the suction purge, even if the suction pump 23 is driven over the same time, the ink amount discharged from the ink jet head 3 still differs according to the viscosity of the inks supplied from the ink tanks 4 to the ink jet head 3. With respect to that, as described above, if the drive time is set for the suction pump 23 with the suction purge on the basis of the mixed ink viscosity Vm, then independently from the mixed ink viscosity Vm, it is possible to discharge an appropriate amount of the inks from the ink jet head 3 in the suction purge.

Further, in the embodiment described above, by driving the suction pump 23 connected to the cap portions 21*a* and 21*b*, the suction purge is carried out to discharge the inks in the ink jet head 3. However, without being limited to that, for example, a pump (the "discharge mechanism" of the present teaching) may be provided for applying a positive pressure to the inks in the upstream ink flow channel of the ink jet head 3 and, by driving that pump to apply the positive pressure to the inks in the ink jet head 3, a positive pressure purge may be carried out, i.e., a forcible discharge of the inks in the ink jet head 3. Alternatively, it is allowable to provide, as the discharge mechanism, both the same suction pump as in the embodiment described above, and the abovementioned pump for applying the positive pressure to the inks.

Further, in the embodiment described above, the cover 16 is provided commonly for the four ink tanks 4. However, without being limited to that, a cover may be provided individually for each of the ink tanks 4, and a cover sensor 35 may be provided individually for each of the covers. In such a case, when a certain ink tank 4 is refilled with the ink, if the cover for that ink tank 4 is opened or closed, then because the corresponding cover sensor 35 will detect the opening or closing of the cover, there are no need of the process of the steps S104 and S105 of the embodiment described above, and the process of the steps S104 and S105 of the fourth modified embodiment. Further, in this case, the cover and the tank cap 33 may be formed integrally and, when the cover is opened, the tank cap 33 is detached from the ink refill portion 32 whereas when the cover is closed, the tank cap 33 is fitted onto the ink refill portion 32. Further, in this case, in addition to providing each ink tank 4 with the individual cover in the printer, a common cover may be provided to collectively cover the ink tanks 4 and the individual covers for the ink tanks 4.

Alternatively, as explained earlier on with the example, the present teaching was applied to a printer including a so-called serial head, that is, the ink jet head 3 mounted on the carriage 2 to move in the scanning direction. However, without being limited to that, for example, it is possible to apply the present teaching to a printer including a so-called line head extending over the entire length of the recording paper P in the scanning direction. In such a case, for example, a device (the "relative motion mechanism" of the present teaching) may be provided for moving the nozzle cap within a horizontal plane and in the up/down direction such that it is possible to switch between the state of the plurality of nozzles being covered with the nozzle cap, and the state of the nozzle cap being away from the line head.

Alternatively, in a printer including a line head, as a relative motion mechanism for relatively moving the line head and the nozzle cap, for example, in addition to the above configuration, a device may be provided for moving the nozzle cap in the up/down direction such that it is possible to switch between the state of the plurality of nozzles being covered with the nozzle cap, and the state of the nozzle cap being away from the line head. Alternately, for example, in a printer including a line head with the nozzle cap being fixed, a device (the "relative motion mechanism" of the present teaching) may be provided for moving the line head such that it is possible to switch between the state of the plurality of nozzles being covered with the nozzle cap, and the state of the nozzle cap being away from the line head.

Further, the above explanation was made with an example of applying the present teaching to a printer which jets ink from nozzles to carry out printing. However, without being limited to that, for example, it is also possible to apply the present teaching to liquid discharging apparatuses which jet liquid other than ink such as a wiring pattern material for a wiring substrate, or the like.

What is claimed is:

1. A liquid discharging apparatus comprising:

a liquid discharge head;

a tank fluidly connected with the liquid discharge head and including a refill port; and a controller configured to perform:

estimating an amount of liquid remained in the tank at a point of time of starting a refill of the tank with the liquid;

estimating a viscosity of the liquid remained in the tank at the point of time of starting the refill of the tank with the liquid;

estimating an amount of the liquid refilled;

estimating a viscosity of the liquid refilled; and estimating a viscosity of the liquid, in which the liquid remained in the tank and the liquid refilled are mixed, at a point of time of finishing the refill of the tank with the liquid, based on the estimated amount of the liquid remained in the tank, the estimated viscosity of the liquid remained in the tank, the estimated amount of the liquid refilled, and the estimated viscosity of the liquid refilled.

2. The liquid discharging apparatus according to claim 1, wherein the controller is configured to perform:

estimating an amount of liquid consumption of the liquid discharge head, from a point of time of finishing a previous refill of the tank with the liquid to a point of time of finishing a current refill of the tank with the liquid; and estimating the amount of the liquid remained in the tank based on the estimated amount of the liquid consumption.

3. The liquid discharging apparatus according to claim 2, wherein the controller is configured to assume that the tank is refilled with the liquid as much as up to a maximum storage volume of the tank at the point of time of the previous refill of the tank with the liquid, and perform estimating the amount of the liquid remained in the tank based on a difference between the maximum storage volume of the tank and the amount of the liquid consumption of the liquid discharge head.

4. The liquid discharging apparatus according to claim 1, further comprising an operation panel configured to accept inputting of information about the amount of the liquid refilled, wherein the controller is configured to perform estimating the amount of the liquid refilled based on the information, input to the operation panel, about the amount of the liquid refilled.

5. The liquid discharging apparatus according to claim 1, further comprising a sensor configured to detect an amount of the liquid in the tank, wherein the controller is configured to perform estimating the amount of the liquid refilled based on a detected result of the sensor and the estimated amount of the liquid remained in the tank.

6. The liquid discharging apparatus according to claim 1, further comprising a timer configured to acquire an elapsed time from a point of time of finishing a previous refill of the tank with the liquid to a point of time of a current refill of the tank with the liquid, wherein the controller is configured to perform estimating the viscosity of the liquid remained in the tank based on the elapsed time.

7. The liquid discharging apparatus according to claim 1, further comprising a temperature sensor, wherein the controller is configured to perform:

acquiring information about a temperature history based on information about a temperature detected by the temperature sensor; and estimating the viscosity of the liquid remained in the tank based on the information about the temperature history.

8. The liquid discharging apparatus according to claim 1, further comprising a temperature sensor, wherein the controller is configured to perform estimating the viscosity of the liquid refilled based on information about a temperature detected by the temperature sensor at a point of time of finishing the refill of the tank with the liquid refilled.

9. The liquid discharging apparatus according to claim 1, further comprising a memory configured to store information about a number of refills of the tank with the liquid, wherein the controller is configured to perform:

updating of the information about the number of refills stored in the memory at each time of a signal being input as related to the refill of the tank with the liquid, and correcting the estimated viscosity of the liquid, in which the liquid remained in the tank and the liquid refilled are mixed, by increasing the estimated viscosity of the liquid, in which the liquid remained in the tank and the liquid refilled are mixed, in a case that the number of refills indicated by the information stored in the memory exceeds a predetermined number.

10. The liquid discharging apparatus according to claim 9, further comprising an operation panel configured to accept inputting of information about the amount of the liquid refilled, wherein the controller is configured to perform:

estimating the amount of the liquid refilled based on the information about the amount of the liquid refilled, and setting a smaller correction value for the viscosity of the liquid, in which the liquid remained in the tank and the liquid refilled are mixed, in a case that the information about the amount of the liquid refilled is input from the operation panel than in a case that the information about the amount of the liquid refilled is not input.

11. The liquid discharging apparatus according to claim 1, further comprising a sensor configured to detect a shortage of the liquid in the tank in a case that an amount of the liquid in the tank has become smaller than a predetermined amount, wherein under a condition that the sensor has detected the shortage of the liquid in the tank, and that the tank is refilled with the liquid, the controller estimates that the amount of the liquid remained in the tank is equal to the predetermined amount.

12. The liquid discharging apparatus according to claim 1, wherein the liquid discharge head includes a nozzle, and wherein the controller is configured to perform controlling the liquid discharge head to perform discharging liquid onto a medium from the nozzle by applying a higher energy to the liquid in a case that the estimated viscosity of the liquid, in which the liquid remained in the tank and the liquid refilled are mixed, has a first value than a case that the estimated viscosity of the liquid, in which the liquid remained in the tank and the liquid refilled are mixed, has a second value smaller than the first value.

13. The liquid discharging apparatus according to claim 1, wherein the liquid discharge head includes a nozzle, and wherein the liquid discharging apparatus further comprises:

a discharge mechanism configured to forcibly discharge the liquid in the liquid discharge head from the nozzle;

a liquid receiver; and a relative motion mechanism configured to relatively move at least one of the liquid discharge head and the liquid receiver, and wherein the controller is configured to perform:

controlling the relative motion mechanism such that the nozzle faces the liquid receiver;

controlling the discharge mechanism with the nozzle facing the liquid receiver to purge for discharging the liquid in the liquid discharge head to the liquid receiver from the nozzle; and during the purging, controlling the discharge mechanism to discharge more of the liquid in a case that the estimated viscosity of the liquid, in which the liquid remained in the tank and the liquid refilled are mixed, has a first value than a case that the estimated viscosity of the liquid, in which the liquid remained in the tank and the liquid refilled are mixed, has a second value smaller than the first value.

14. The liquid discharging apparatus according to claim 1, wherein the liquid discharge head includes a nozzle, wherein the liquid discharging apparatus further comprises:

a discharge mechanism configured to forcibly discharge the liquid in the liquid discharge head from the nozzle;

a liquid receiver; and a relative motion mechanism configured to relatively move at least one of the liquid discharge head and the liquid receiver, and wherein the controller is configured to perform:

controlling the relative motion mechanism such that the nozzle faces the liquid receiver;

controlling the discharge mechanism with the nozzle facing the liquid receiver to purge for discharging the liquid in the liquid discharge head to the liquid receiver from the nozzle; and during the purging, controlling the discharge mechanism to discharge at a higher frequency in a case that the estimated viscosity of the liquid, in which the liquid remained in the tank and the liquid refilled are mixed, has a first value than a case that the estimated viscosity of the liquid, in which the liquid remained in the tank and the liquid refilled are mixed, has a second value smaller than the first value.

15. The liquid discharging apparatus according to claim 1, wherein the liquid discharge head includes a nozzle, and wherein the controller is configured to perform:

controlling the liquid discharge head to perform flushing for discharging the liquid from the nozzle; and during the flushing, controlling the liquid discharge head to discharge more of the liquid in a case that the estimated viscosity of the liquid, in which the liquid remained in the tank and the liquid refilled are mixed, has a first value than a case that the estimated viscosity of the liquid, in which the liquid remained in the tank and the liquid refilled are mixed, has a second value smaller than the first value.

16. The liquid discharging apparatus according to claim 1, wherein the liquid discharge head includes a nozzle, and wherein the controller is configured to perform:

controlling the liquid discharge head to perform flushing for discharging the liquid from the nozzle; and controlling the liquid discharge head to perform flushing at a higher frequency in a case that the estimated viscosity of the liquid, in which the liquid remained in the tank and the liquid refilled are mixed, has a first value than a case that the estimated viscosity of the liquid, in which the liquid remained in the tank and the liquid refilled are mixed, has a second value smaller than the first value.

17. A liquid discharging apparatus comprising:

a liquid discharge head;

a tank fluidly connected with the liquid discharge head and including a refill port; and a controller configured to perform:

estimating an amount of liquid remained in the tank at a point of time of starting a refill of the tank with the liquid;

estimating a viscosity of the liquid remained in the tank at the point of time of starting the refill of the tank with the liquid;

estimating an amount of the liquid refilled; and estimating a viscosity of the liquid, in which the liquid remained in the tank and the liquid refilled are mixed, at a point of time of finishing the refill of the tank with the liquid, based on the estimated amount of the liquid remained in the tank, the estimated viscosity of the liquid remained in the tank, the estimated amount of the liquid refilled, and information about a viscosity of the liquid refilled.

* * * * *